US005480755A

United States Patent [19]

Uchiyama et al.

[11] Patent Number: 5,480,755

[45] Date of Patent: Jan. 2, 1996

[54] MAGNETIC TONER, IMAGE FORMING METHOD, SURFACE-MODIFIED FINE SILICA POWDER AND PROCESS FOR ITS PRODUCTION

[75] Inventors: Masaki Uchiyama, Ichikawa; Yoshinobu Jo, Toride; Yasutaka Akashi, Yokohama; Masaaki Taya, Kawasaki; Makoto Unno, Tokyo, all of Japan

[73] Assignee: Canon Kabushiki Kaisha, Tokyo, Japan

[21] Appl. No.: 293,115

[22] Filed: Aug. 19, 1994

Related U.S. Application Data

[63] Continuation of Ser. No. 846,902, Mar. 6, 1992, abandoned.

[30] Foreign Application Priority Data

Mar. 8, 1991 [JP] Japan ..... 3-067751
Mar. 8, 1991 [JP] Japan ..... 3-067752

[51] Int. Cl.[6] ..... G03G 9/083

[52] U.S. Cl. ..... 430/106.6; 430/110; 430/111

[58] Field of Search ..... 430/106.6, 110, 430/111

[56] References Cited

U.S. PATENT DOCUMENTS

| | | | |
|---|---|---|---|
| 4,702,986 | 10/1987 | Imai et al. | 430/120 |
| 4,857,432 | 8/1989 | Tanikawa et al. | 430/106.6 |
| 5,041,351 | 8/1991 | Kitamori et al. | 430/110 |

FOREIGN PATENT DOCUMENTS

| | | | |
|---|---|---|---|
| 270063 | 6/1988 | European Pat. Off. . | |
| 2569874 | 3/1986 | France . | |
| 2635882 | 3/1990 | France . | |
| 55-120041 | 9/1980 | Japan . | |
| 60-107036 | 6/1985 | Japan . | |
| 2308174 | 12/1990 | Japan | 430/106.6 |
| 2222463 | 3/1990 | United Kingdom . | |

*Primary Examiner*—Roland Martin
*Attorney, Agent, or Firm*—Fitzpatrick, Cella, Harper & Scinto

[57] ABSTRACT

A magnetic toner has magnetic resin particles containing at least a binder resin, a charge control agent and a magnetic powder. The surface-modified fine silica powder being a fine silica powder has been treated with a hydrophobicizing agent. The fine silica powder has a specific surface area of not less than 180 $m^2/g$, a hydrophobicity of from 60% to 95% and a bulk density of from 35 g/lit. to 49 g/lit.

20 Claims, 1 Drawing Sheet

MAGNETIC TONER, IMAGE FORMING METHOD, SURFACE-MODIFIED FINE SILICA POWDER AND PROCESS FOR ITS PRODUCTION

This application is a continuation of application Ser. No. 07/846,902 filed Mar. 6, 1992, now abandoned.

BACKGROUND OF THE INVENTION

1. Field of the Invention

The present invention relates to a magnetic toner having at least magnetic resin particles and a surface-modified fine silica powder, contained in a developer for developing an electrostatic image to convert the electrostatic latent image to a visible image in image forming methods utilizing electrophotography, static recording, static printing or the like. It also relates to an image forming method making use of such a magnetic toner. More particularly, the present invention relates to a magnetic toner suited for high-speed image formation using an amorphous silicon drum as an electrostatic image bearing member.

The present invention is also concerned with a surface-modified fine silica powder preferably used as an additive for a developer for developing an electrostatic image to convert the electrostatic latent image to a visible image in image forming methods utilizing electrophotography, static recording, static printing or the like. More particularly, the present invention is concerned with a surface-modified fine silica powder suitable as an additive for a developer used in high-speed image formation using an amorphous silicone drum as an electrostatic image bearing member.

2. Related Background Art

A method commonly known as an image forming method that carries out electrophotography is a method in which, using a photosensitive drum as an electrostatic image bearing member, the surface of the photosensitive drum is uniformly charged by a charging means such as a corona charging assembly. The drum is then imagewise exposed to light to form an electrostatic latent image on the surface of the photosensitive drum, and the electrostatic latent image is developed by a developing process such as jumping development or magnet brushing, using a developer having a magnetic toner, to thereby form a toner image on the photosensitive drum surface. The toner image is further transferred to a recording medium and then fixed thereon.

Developers used for converting the electrostatic latent image on the surface of a photosensitive member to a visible image include two-component developers comprised of a mixture of a magnetic carrier such as iron powder or ferrite powder and a toner having a resin and a colorant and one-component developers that make use of no carrier.

In the development making use of the two-component developers, the quality of toner images greatly depends on the mixing ratio of toner and carrier, i.e., the toner concentration in a two-component developer, and hence the toner concentration in the developer must be controlled so as to be always constant, making the process troublesome.

On the other hand, compared with the above two-component type developing system, the development using the one-component developers, which makes use of magnetic toners mainly composed of a resin and magnetic powder, has the advantages that no device for keeping the toner concentration constant is required which makes the process easy to use and also developing apparatus can be made small-sized.

In the system in which a one-component developer having a magnetic toner is used, the developer that must be coated on a developer carrying member, a sleeve, in a thin layer, tends to be coated on the sleeve in a very large thickness to cause background fogging. The phenomenon of agglomeration of magnetic toner gradually begins to occur with an increase in charges of the magnetic toner. In particular, such a problem tends to occur in high-speed copying machines which take copies on 50 sheets or more per minute.

To solve such a problem, Japanese Patent Application Laid-open No. 55-120041 discloses a method in which an insulating magnetic toner is made to contain fine silicon dioxide particles with a pH of 7 or more, having a trimethylsiloxyl group, i.e., hydrophobic fine silica powder. Addition of such hydrophobic fine silica powder brings about a tendency toward control of an increase in charges of the insulating magnetic toner. However, in the high-speed copying machines, such addition brings about an increase in charges in a low-humidity environment to sometimes cause problems such as a decrease in image density and the background fogging.

The fine silica powder when made hydrophobic tends to form agglomerates when so treated, and may often form agglomerates of several hundred μm in size during the treatment. Such agglomerates inhibit chargeability of toners to cause a decrease in charges of toners. Moreover, agglomerates with such a large particle size have so small a specific surface area ($m^2/g$) and so weakly interact with toner particles that they tend to be separated from the toner particles. Hence the agglomerates tend to scatter alone from a developing assembly.

The agglomerates having scattered therefrom have so small a specific gravity that they fly about inside a copying machine according to air currents inside the copying machine and reach a discharge wire used for corona charging, so that the wire of the charging assembly is soiled. The part at which the wire has been soiled gives a weak corona discharge to make non-uniform the charge distribution of the corona charging assembly, so that images formed tend to have a density uneveness. The soiling of wire with silica is not a problem peculiar to one-component developers, and is a problem that may be also caused in two-component developers. Japanese Patent Application Laid-open No. 60-107036 discloses, as a method by which the discharge wire is better prevented from being soiled with fine silica powder, a method in which the fine silica powder is controlled to have a bulk density of not more than 30 g/lit and is added in a developer in a smaller quantity so that any difficulty that may occur when added in a large quantity can be lessened or relieved. However, although this method can be effective for relieving the difficulty, the problem of the soiling of wire caused by the addition of fine silica powder still substantially remains, and hence the discharge wire is soiled as a result of repeated copying on several tens of thousands of copy sheets.

In particular, an amorphous silicon photosensitive member having a superior durability required for photosensitive members is excellent as a photosensitive drum used for high-speed copying machines. In order to maintain the dark portion surface potential, however, it requires a corona discharge current having a larger volume, exceeding 500 μA, than photosensitive members of other types. Thus, the discharge wire used therefor tends to be soiled more with fine silica powder.

As stated above, it is sought to provide a durable fine silica powder of excellent durability capable of being used in developers for high-speed copying machines.

SUMMARY OF THE INVENTION

An object of the present invention is to provide a magnetic toner that has solved the above problems involved in the prior art.

Another object of the present invention is to provide a magnetic toner containing surface-modified fine silica powder, capable of having stable charges and free from difficulties such as the soiling of wire that may result from running on a large number of copy sheets, and an image forming method making use of such a magnetic toner.

Still another object of the present invention is to provide a surface-modified fine silica powder that has solved the above problems involved in the prior art, and a process for producing the same.

A further object of the present invention-is to provide a surface-modified fine silica powder capable of giving stable charges to a toner and causing no difficulties such as the soiling of wire that may result from running on a large number of copy sheets, and a process for producing the same.

The present invention provides a magnetic toner comprising magnetic resin particles containing at least a binder resin, a charge control agent and a magnetic powder, and a surface-modified fine silica powder; said surface-modified fine silica powder being a fine silica powder having been treated with a hydrophobicizing agent, said fine silica powder having a specific surface area of not less than 180 $m^2/g$, a hydrophobicity of from 60% to 95% and a bulk density of from 35 g/lit. to 49 g/lit.

The present invention also provides an image forming method comprising;

charging an amorphous silicone drum by means of a corona charger;

exposing said amorphous silicon drum to light to form thereon an electrostatic latent image;

developing said electrostatic latent image with a magnetic toner carried on a developing sleeve, to form a magnetic toner image; said magnetic toner comprising magnetic resin particles containing at least a binder resin, a charge control agent and a magnetic powder, and a surface-modified fine silica powder; said surface-modified fine silica powder being a fine silica powder having been treated with a hydrophobicizing agent, said fine silica powder having a specific surface area of not less than 180 $m^2/g$, a hydrophobicity of from 60% to 95% and a bulk density of from 35 g/lit. to 49 g/lit;

transferring said magnetic toner image on said amorphous silicon drum to a transfer medium; and fixing said magnetic toner image formed on said transfer medium.

The present invention still also provides a fine silica powder comprising a surface-modified fine silica powder obtained by treating a fine silica powder with a hydrophobicizing agent; said surface-modified fine silica powder having a specific surface area of not less than 180 $m^2/g$, a hydrophobicity of from 60% to 95% and a bulk density of from 35 g/lit. to 49 g/lit.

The present invention further provides a process for producing a surface-modified fine silica powder, comprising the steps of;

mixing 100 parts by weight of a fine silica powder having a specific surface area of not less than 300 $m^2/g$, a water content of from 0.5% by weight to 5% by weight and a bulk density of not more than 40 g/lit and from 15 parts by weight to 25 parts by weight of hexamethyldisilazane; and heating said fine silica powder mixed with hexamethyldisilazane, at a temperature not lower than the boiling point of hexamethyldisilazane to give a surface-modified fine silica powder having a specific surface area of not less than 180 $m^2/g$, a hydrophobicity of from 60% to 95% and a bulk density of from 35 g/lit. to 49 g/lit.

DESCRIPTION OF THE PREFERRED EMBODIMENTS

Figure 1:
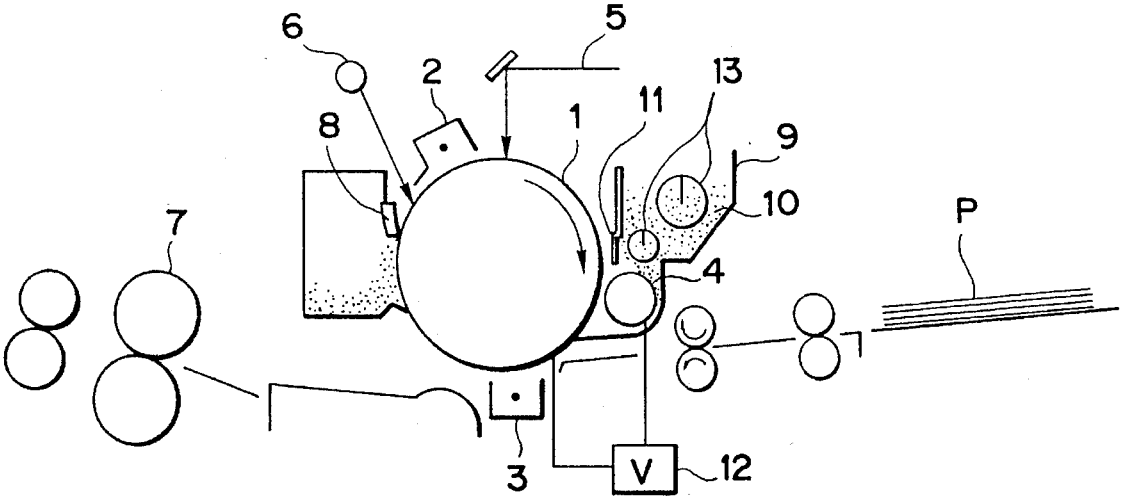
FIG. 1 is a schematic illustration of an image forming apparatus to which the magnetic toner of the present invention can be preferably applied.

As a result of extensive studies, the present inventors have discovered that a magnetic toner having a surface-modified fine silica powder with specific physical properties that can make the toner free from agglomerates causing the soiling of discharge wire, which have been so strongly stiffened as not to be broken up even in the step of disintegration or the step of external addition, can be obtained. A starting material of fine silica powder having a given specific surface area and bulk density is treated with a given amount of a hydrophobicizing agent (an agent for making the powder hydrophobic), in particular, hexamethyldisilazane to give a surface-modified fine silica powder, which is contained in a magnetic toner together with magnetic resin particles.

In the present invention, the starting material fine silica powder used when the surface-modified fine silica powder is produced must be controlled to have a specific surface area of not less than 300 $m^2/g$. This makes it possible to obtain the surface-modified fine silica powder with a specific surface area of not less than 180 $m^2/g$ that can prevent agglomerates of fine silica powder from being formed when the powder is made hydrophobic. The starting material fine silica powder should preferably be controlled to have a specific surface area of from 350 to 500 $m^2/g$. This makes it possible to obtain a surface-modified fine silica powder with a specific surface area of from 200 to 320 $m^2/g$ that can more improve fluidity and durability of the developer. A starting material fine silica powder with a specific surface area smaller than 300 $m^2/g$ tends to cause formation of agglomerates when treated to be made hydrophobic, making it difficult for the resulting surface-modified fine silica powder to have a specific surface area of not less than 180 $m^2/g$.

The specific surface area of the fine powder according to the present invention is a value calculated by the following method.

Specific Surface Area

According to the BET method, nitrogen gas is adsorbed on the surface of a sample, and the quantity of absorption is determined on the basis of the differential pressure indicated by a manometer, from which the specific surface area is calculated.

In the present invention, the starting material fine silica powder used when the surface-modified fine silica powder is produced may preferably be controlled to have a bulk density of not more than 40 g/lit. This makes it difficult for agglomerates to be formed in the starting material fine silica powder and also makes it possible to prevent agglomerates from being formed when the powder is made hydrophobic, so that the resulting surface-modified fine silica powder can be well made to have a bulk density of from 35 to 49 g/lit. A starting material fine silica powder with a bulk density higher than 40 g/lit. tends to cause formation of agglomerates in the starting material fine silica powder. If the starting material fine silica powder containing such agglomerates is treated, the agglomerates in the starting material can not be broken up when treated, and remain as they are, tending to cause the soiling of discharge wire. In view of the readiness in handling, it is preferable to use a starting material fine silica powder having a bulk density of not less than 20 g/lit.

The bulk density of the fine powder according to the present invention is a value obtained by the following method.

Bulk Density

In a 100 ml measuring cylinder, a sample placed on paper is slowly added to give a quantity of 100 ml. On this occasion, the paper should never be tapped. A difference in weight before and after addition of the sample is determined and the bulk density is calculated according to the following expression.

Bulk density (*g/lit.*)=weight of sample (*g*)×10

The fine silica powder may be treated using hexamethyldisilazane in an amount of from 15 to 25 parts by weight based on 100 parts by weight of the starting material fine silica powder, whereby the surface-modified fine silica powder with less agglomerates and with the properties required in the present invention can be obtained. Use of the hexamethyldisilazane agent in amounts less than 15 parts by weight may make insufficient the surface modification of fine silica powder, tending to bring about a decrease in charges of the toner in a high-humidity environment to cause a decrease in density. On the other hand, addition of hexamethyldisilazane in an amount more than 25 parts by weight makes the amount of hexamethyldisilazane excessive compared to the fine silica powder and tends to cause the formation of agglomerates and cause the soiling of discharge wire. Moreover, addition of hexamethyldisilazane in an amount more than 25 parts by weight causes the surface-modified fine silica powder to have a specific surface area smaller than 180 $m^2/g$. This makes it difficult to maintain, in the course of operation, the fluidity required as toners for high-speed copying machines, tending to cause background fogging, a lowering of line image reproduction, and particularly, scattering of the toner.

The water content in the starting material fine silica powder accelerates the reaction of hexamethyldisilazane with silanol groups present on the surfaces of fine silica powder particles. Thus the present inventors have found that the hydrophobicity (the degree to which powder has been made hydrophobic) of the surface-modified fine silica powder can be controlled by water content.

The starting material fine silica powder may have a water content of from 0.5 to 5% by weight, whereby the surface-modified fine silica powder obtained by treatment with hexamethyldisilazane can be well controlled to have a hydrophobicity within the range of from 60 to 95%. Its water content may more preferably be set to from 0.7 to 3% by weight, whereby the surface-modified fine silica powder can be made to have a hydrophobicity of from 70 to 90% and a developer with a superior developing performance and durability can be obtained.

A starting material fine silica powder with a water content less than 0.5% by weight can not properly cause the reaction of hexamethyldisilazane with silanol groups on the surfaces of fine silica powder particles, tending to make the resulting surface-modified fine silica powder to have a hydrophobicity of less than 60%. On the other hand, a starting material fine silica powder with a water content more than 5% by weight may result in an excess surface-modification of fine silica powder, highly tending to make the resulting surface-modified fine silica powder to have a hydrophobicity of more than 95%.

The hydrophobicity of the surface-modified fine silica powder according to the present invention is a value obtained by the following method.

Hydrophobicity Test

In a separatory funnel, 1 g of sample is taken, and 100 ml of pure water is added thereto before the separatory funnel is stoppered, followed by shaking for 10 minutes using a tumbler shaker mixer. After the shaking, the separatory funnel is left to stand for 10 minutes. Thereafter, the lower layer aqueous mixture is collected from the separatory funnel in a quantity of 20 to 30 ml. The collected lower layer aqueous mixture is then dispensed in a 10 mm quartz cell and set in a colorimeter using pure water as a blank. The transmittance thus measured is regarded as the hydrophobicity.

The surface-modified fine silica powder of the present invention, prepared from the starting material fine silica powder described above, has the following physical properties.

The surface-modified fine silica powder according to the present invention has a specific surface area of not less than 180 $m^2/g$. Hence, mixing this surface-modified fine silica powder with a magnetic toner makes it possible to maintain the fluidity of the developer for high-speed copying machines in a good state even in the course of running on a large number of copy sheets and also makes it possible to give a developer that may cause less background fogging and can achieve a superior line image reproduction. The surface-modified fine silica powder may preferably have a specific surface area of from 200 to 320 $m^2/g$ in view of stable fluidity.

The surface-modified fine silica powder of the present invention has a bulk density of from 35 to 49 g/lit., and hence exhibits a superior performance against the soiling of discharge wire. A surface-modified fine silica powder with a bulk density lower than 35 g/lit. may result in an excessively high fluidity of the magnetic toner when added to the magnetic toner in a quantity large enough to satisfy the developing performance and durability. This makes the magnetic toner more liable to scatter or fly, resulting in the soiling of the discharge wire, and also may contaminate the transfer medium transport zone to tend to cause image stain. A surface-modified fine silica powder with a bulk density higher than 49 g/lit. may make agglomerates present in a large number in the resulting surface-modified fine silica powder to cause the soiling of discharge wire, and also such agglomerates present in the surface-modified fine silica powder may inhibit charge performance of the magnetic toner, tending to cause a decrease in image density.

In particular, a surface-modified fine silica powder having a bulk density within the range of from 38 to 45 g/lit. can give a magnetic toner with a particularly superior performance.

The surface-modified fine silica powder has a hydrophobicity of from 60 to 95% and hence makes it possible to give a developer with a superior durability. It should preferably have a hydrophobicity of from 70 to 90%, which makes it possible to obtain a developer with a superior developing performance and durability.

A surface-modified fine silica powder with a hydrophobicity less than 60% tends to result in a lowering of chargeability in a high-humidity environment, causing a decrease in image density. A surface-modified fine silica powder with a hydrophobicity more than 95% may result in an increase in its charges during the running on a large number of copy sheets, in particular, during the running on a large number of copy sheets in a low-humidity environment, tending to cause background fogging or black spots around line images. Moreover, the increase in charges may cause a decrease in image density.

The process for producing the surface-modified fine silica powder of the present invention will be described below.

The starting material fine silica powder having a specific surface area of not less than 300 $m^2/g$, a water content of from 0.5% by weight to 5% by weight and a bulk density of not more than 40 g/lit is stirred at a high speed, in the course of which hexamethyldisilazane is dropwise added or sprayed in a given amount (from 15 to 25 parts by weight based on 100 parts by weight if the starting material fine silica powder) followed by thorough mixing. Here, the hexamethyldisilazane may be diluted with a solvent such as alcohol to carry out the treatment. The starting material fine silica powder containing the treating agent mixed and dispersed therein is in the form of a powder liquid. This powder liquid is heated in a nitrogen atmosphere to a temperature (preferably from 150° to 250° C.) not lower than the boiling point of hexamethyldisilazane, and refluxed with stirring for 0.5 hour to 5 hours. Thereafter, if necessary any excess treating agent and so forth may be removed. After the treatment has been completed, the powder may be cooled to room temperature. Thus the surface-modified fine silica powder of the present invention can be obtained.

A treatment method to obtain the surface-modified fine silica powder according to the present invention may preferably be a batch treatment method in which the treatment of the starting material fine silica powder with hexamethyldisilazane is carried out with stirring in a batch mixer. The batch treatment method can give a surface-modified fine silica powder to which the treatment has been uniformly applied and also can give quality-stable products in a good reproducibility.

As another method, there is a continuous treatment method in which hexamethyldisilazane is acted on starting material fine silica powder dispersed in an air stream. It, however, is difficult for this continuous treatment method to uniformly and also properly treat the starting material fine silica powder, consequently giving a surface-modified fine silica powder lacking uniformity and reproducibility, and it also difficult to carry out sufficient treatment when often causes changes in performance with time. Hence, this method is not so much preferable.

The starting material fine silica powder with a bulk density of not more than 40 g/lit. can be prepared by, for example, a method in which commercially available fine silica powder having a bulk density of about 70 g/lit. is disintegrated. Needless to say, any other method may also be used. The starting material fine silica powder may be prepared by any method so long as it is a fine silica powder with a bulk density of not more than 40 g/lit.

The starting material fine silica powder with a water content of from 0.5 to 5% by weight can be prepared by, for example, a method in which commercially available fine silica powder having a water content of about 0.5% by weight to about 5% by weight is moistened or dried. Needless to say, any other method may also be used. The starting material fine silica powder may be prepared by any method so long as it is a fine silica powder with a water content of from 0.5 to 5% by weight.

In the case when the magnetic toner is prepared by adding the surface-modified fine silica powder of the present invention, as described above, to the magnetic resin particles containing a binder resin, a charge control agent and a magnetic powder, the surface-modified fine silica powder is free from agglomerates, or contains agglomerates only in a small quantity, and also has an appropriate hydrophobicity. Hence, the interaction between the surface-modified fine silica powder and the magnetic resin particles becomes strong enough to withhold the surface-modified fine silica powder from being released from the magnetic resin particles, so that the discharge wire can be much better prevented from being soiled and also an improvement can be made in image reproducibility such as image density obtained in the course of running and under various environmental conditions.

The surface-modified fine silica powder should be added in an amount of from 0.05 to 5% by weight, and preferably from 0.1 to 4% by weight, based on the weight of the magnetic toner.

The magnetic resin particles according to the present invention will be described below.

The binder resin contained in the magnetic resin particles may include homopolymers of styrene or homopolymers of derivatives thereof such as polystyrene, poly-p-chlorostyrene and polyvinyltoluene; styrene copolymers such as a styrene/p-chlorostyrene copolymer, a styrene/propylene copolymer, a styrene/vinyltoluene copolymer, a styrene/vinylnaphthalene copolymer, a styrene/methyl acrylate copolymer, a styrene/ethyl acrylate copolymer, a styrene/butyl acrylate copolymer, a styrene/octyl acrylate copolymer, a styrene/methyl methacrylate copolymer, a styrene/ethyl methacrylate copolymer, a styrene/butyl methacrylate copolymer, a styrene/methyl α-chloromethacrylate copolymer, a styrene/methyl vinyl ether copolymer, a styrene/acrylonitrile copolymer, a styrene/ethyl vinyl ether copolymer, a styrene/methyl vinyl ketone copolymer, a styrene/butadiene copolymer, a styrene/isoprene copolymer and a styrene/acrylonitrile/indene copolymer; polyvinyl chloride, polyvinyl acetate, polyethylene, polypropylene, silicone resin, polyester resin, epoxy resin, polyvinyl butyral, rosin, modified rosin, terpene resin, phenol resin, xylene resin, aliphatic or alicyclic hydrocarbon resins, aromatic petroleum resins, chlorinated paraffin, and paraffin wax. These may be used alone or in the form of a mixture.

Of these resins, styrene-acrylic copolymers are preferably used in the present invention. Of the styrene-acrylic copolymers, particularly preferred are copolymers having a vinyl monomer containing a carboxyl group.

The vinyl monomer containing a carboxyl group may include, for example, unsaturated dibasic acids such as maleic acid, citraconic acid, itaconic acid, alkenylsuccinic acid, fumaric acid and mesaconic acid; unsaturated dibasic acid anhydrides such as maleic anhydride, citraconic anhydride, itaconic anhydride and alkenylsuccinic anhydride; half esters of unsaturated dibasic acids such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester and mesaconic acid methyl half ester; and unsaturated dibasic acid esters such as dimethyl maleate and dimethyl fumarate. It may also include α, β-unsaturated acids such as acrylic acid, methacrylic acid, crotonic acid and cinnamic acid; α, β-unsaturated acid anhydrides such as crotonic anhydride and cinnamic anhydride; anhydrides of such α, β-unsaturated acids and lower fatty acids; alkenylmalonic acid, alkenylglutaric acid, alkenyladipic acid, anhydrides thereof, and monoesters thereof.

Of these, particularly preferred are monomers having a maleic acid structure, fumaric acid structure of succinic acid structure.

As the charge control agent contained in the magnetic resin particles according to the present invention, an organic acid metal complex salt or a chelate compound is effective, which may include monoazo metal complexes, acetylacetone metal complexes, aromatic hydroxycarboxylic acid or aromatic dicarboxylic acid metal complexes. Besides, the charge control agent may include aromatic hydroxycarboxylic acids, aromatic mono- or polycarboxylic acids, and metal salts, anhydrides or esters thereof, and phenol derivatives thereof such as bisphenols.

Of these, it is preferable to use a charge control agent such as an azo type metal complex represented by the following Formula (I) or a basic organic acid metal complex represented by Formula

FORMULA (I)

Azo Type Metal Complex

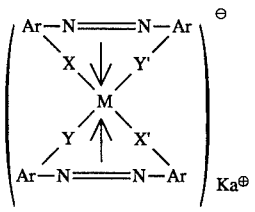

In the formula, M represents a coordination central metal. As M having the coordination number of 6, it represents Sc, Ti, V, Cr, Co, Ni, Mn or Fe. Ar represents an aryl group as exemplified by a phenyl group or a naphthyl group, which may have a substitutent. Such a substituent may include a nitro group, a halogen atom, a carboxyl group, an anilide group and an alkyl group or alkoxyl group having 1 to 18 carbon atoms. X, X', Y and Y' each represent —S—, —O—, —CO—, —NH— or —NR—, wherein R represents an alkyl group having 1 to 4 carbon atoms. $Ka^{\oplus}$ a represents a hydrogen ion, a sodium ion, a potassium ion, an ammonium ion or an organic ammonium ion.

FORMULA (II)

Basic Organic Acid Metal Complex

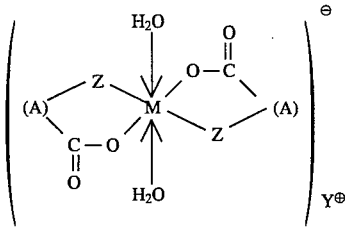

In the formula, M represents a coordination central metal. As M having the coordination number of 6, it represents Sc, Ti, V, Cr, Co, Ni, Mn or Fe. A represents

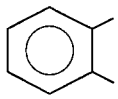

which may have a substitutent such as an alkyl group,

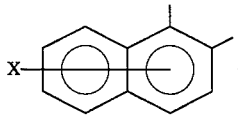

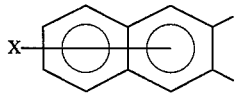

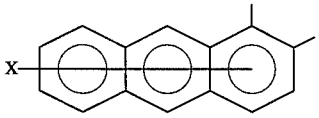

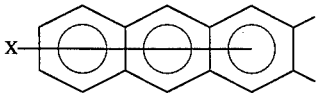

wherein X represents a substituent such as a hydrogen atom, a halogen atom, a nitro group or an alkyl group, or

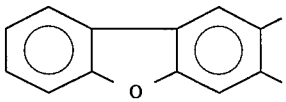

-continued

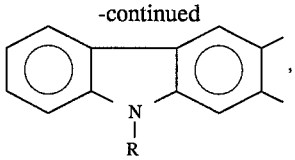

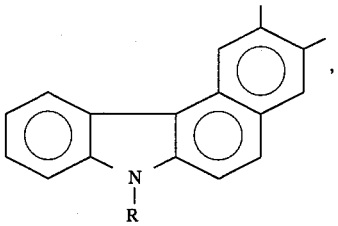

wherein R represents a hydrogen atom, an alkyl or alkenyl group having 1 to 18 carbon atoms. $Y^{\oplus}$ represents a hydrogen ion, a sodium ion, a potassium ion, an ammonium ion or an organic ammonium ion. Z represents —O— or $$-\overset{\overset{\displaystyle O}{\|}}{C}-O-.$$

Exemplary compounds of the azo type complex represented by Formula (I) are shown below.

Complex (I)-1

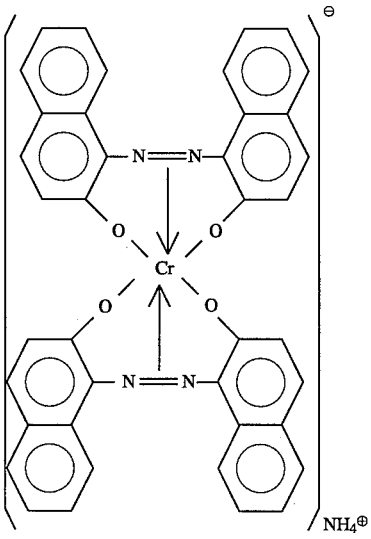

-continued

Complex (I)-2

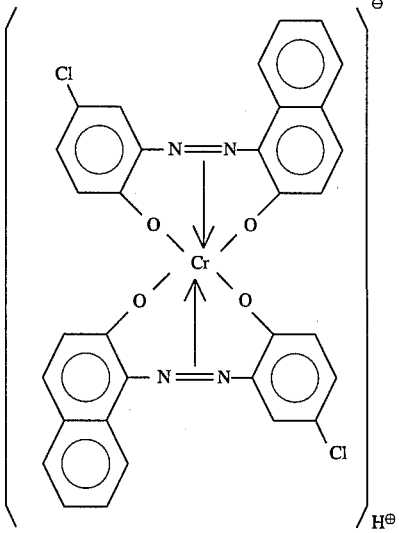

Complex (I)-3

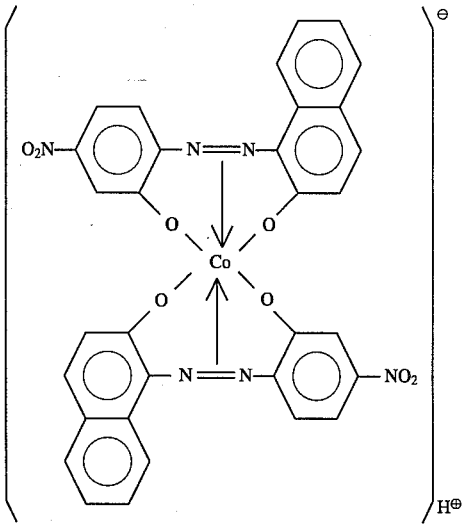

Complex (I)-4

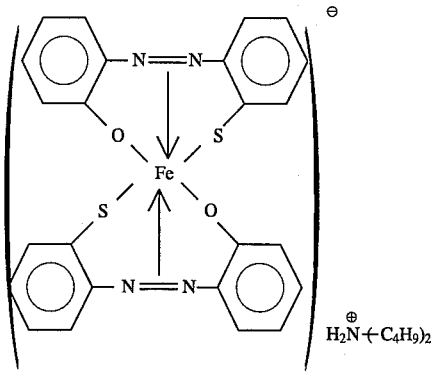

-continued
Complex (I)-5
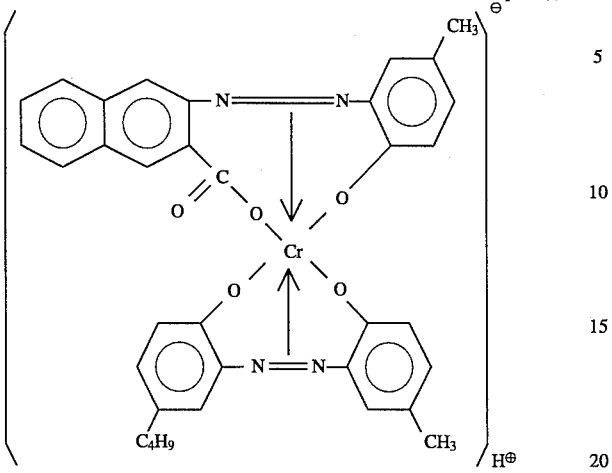
Complex (I)-6
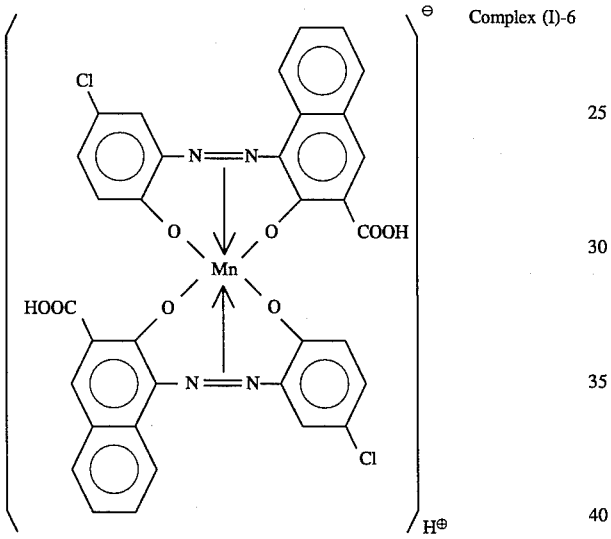
Exemplary compounds of the basic organic acid metal complex represented by Formula (II) are shown below.
Complex (II)-1
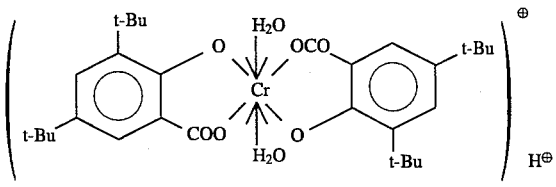
Complex (II)-2
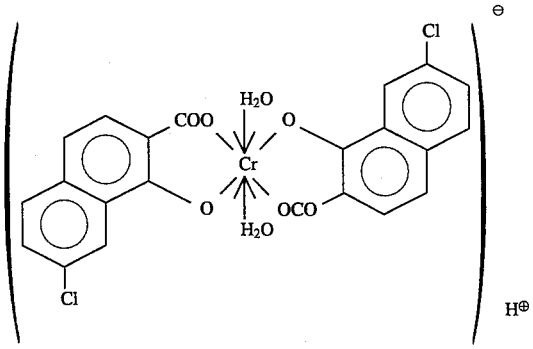

-continued
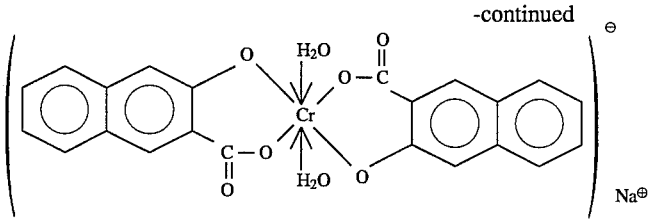
Complex (II)-3
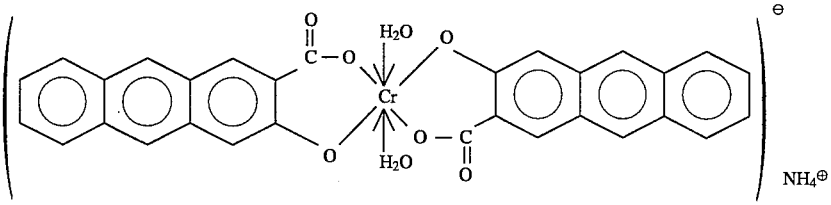
Complex (II)-4
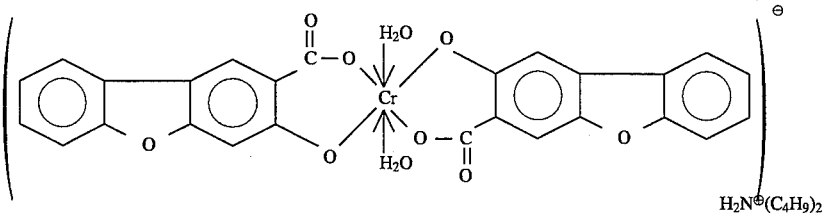
Complex (II)-5
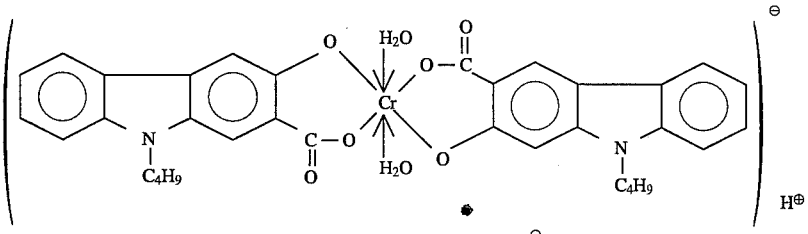
Complex (II)-6
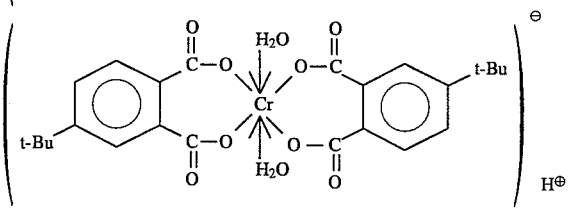
Complex (II)-7
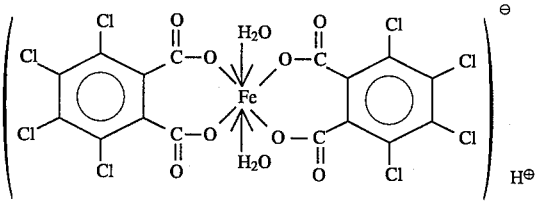
Complex (II)-8
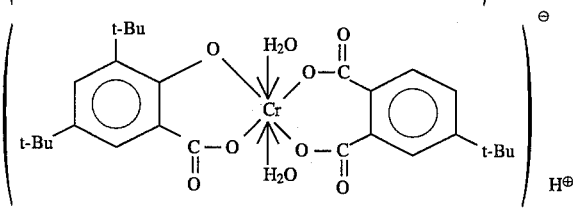
Complex (II)-9
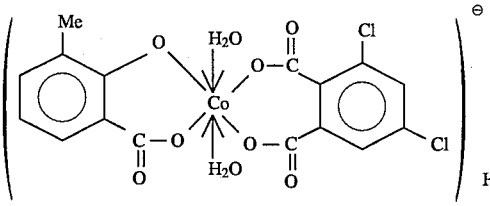
Complex (II)-10
These charge control agents can be used alone or in combination of two or more.

The charge control agent may preferably be added to the magnetic resin particles in an amount, which may vary depending on the type of the binder resin and magnetic powder in the magnetic resin particles or the proportion of their content, of from 0.1 to 10% by weight based on the weight of the binder resin.

The magnetic powder also contained in the magnetic resin particles according to the present invention may include ferromagnetic materials such as iron oxides as exemplified by magnetite, hematite and ferrite; and metals as exemplified by iron, cobalt and nickel or alloys of any of these metals and any of metals such as aluminum, cobalt, copper, lead, magnesium, tin, zinc, antimony, beryllium, bismuth, cadmium, calcium, manganese, selenium, titanium, tungsten and vanadium, and mixtures thereof.

These ferromagnetic materials may preferably be those having an average particle diameter of from 0.05 to 2 μm, and more preferably from 0.1 to 0.5 μm.

In the magnetic resin particles, the magnetic powder should preferably be contained in an amount of from about 20 to 200 parts by weight based on 100 parts by weight of the resin components containing the binder resin, particularly preferably from 40 to 150 parts by weight based on 100 parts by weight of the resin components containing the binder resin.

The magnetic powder may preferably be those having, as magnetic characteristics under application of 10 KOe, a coercive force of from 20 to 150 oersted (Oe), a saturation magnetization of from 50 to 200 emu/g and a residual magnetization of from 2 to 20 emu/g.

For the purpose of improving release properties at the time of heat-roll fixing, it is preferable to add to the magnetic resin particles a waxy material such as a low-molecular polyethylene, a low-molecular polypropylene, microcrystalline wax, carnauba wax, sazole wax or paraffin wax in an amount of from 0.5 to 10 parts by weight based on 100 parts by weight of the binder resin.

Other additives may also be optionally used in the magnetic toner of the present invention.

Such other additives can be exemplified by lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); fluidity-providing agents such as titanium oxide and aluminum oxide (in particular, hydrophobic ones are preferred); anti-caking agents; and conductivity-providing agents such as carbon black, zinc oxide, antimony oxide and tin oxide. It is also possible to use as a developability improver a small amount of white fine particles or black fine particles having a polarity reverse to that of toner particles.

Figure 2:
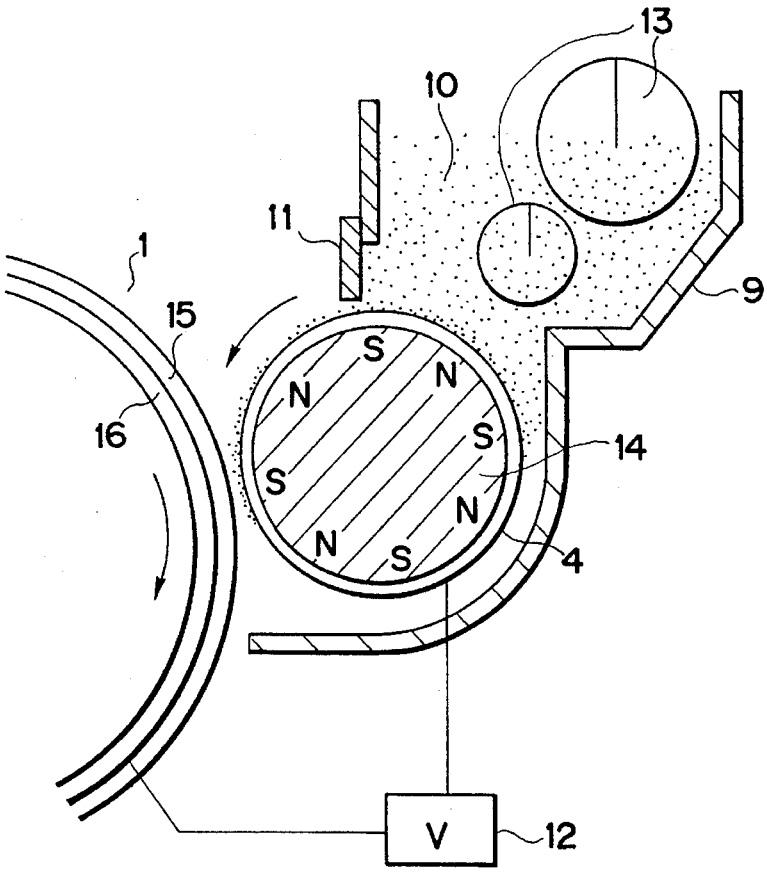
FIG. 2 is an enlarged view of a developing zone of the apparatus shown in FIG. 1.

An image forming method to which the magnetic toner of the present invention can be preferably applied will be described below with reference to FIGS. 1 and 2.

The surface of a photosensitive member 1 such as an amorphous silicone drum is positively charged by the operation of a primary charger 2 such as a corona charging assembly, and then exposed to light 5 to form an electrostatic latent image. The latent image thus formed is developed using a magnetic toner containing one-component developer 10 held in a developing assembly 9 equipped with a magnetic blade 11 and a developing sleeve 4 in which a magnet 14 is provided. In the developing zone, an AC bias, a pulse bias and/or a DC bias is/are applied across a conductive substrate 16 of the photosensitive drum 1 and the developing sleeve 4 through a bias applying means 12. A transfer medium such as transfer paper P is fed and delivered to a transfer zone, where the transfer paper P is electrostatically charged from its back surface (the surface opposite to the photosensitive drum) through a transfer charging assembly 3, so that the negatively charged toner image on the surface of the photosensitive drum 1 is electrostatically transferred to the transfer paper P. The transfer paper P separated from the photosensitive drum 1 is subjected to fixing using a heat-pressure roller fixing unit 7 so that the toner image on the transfer paper P can be fixed. In the case of the amorphous silicon drum, the value of the electric current flowed through the primary charging assembly 2 should preferably be set to 600 to 2,000 μA, and more preferably set to 700 to 1,500 μA.

The one-component developer remaining on the photosensitive drum 1 after the transfer step is removed by the operation of a cleaning assembly 8 having a cleaning blade. After the cleaning, the residual charges on the latent image bearing member 1 are eliminated by erase exposure 6, and thus the procedure again starting from the charging step using the primary charging assembly 2 is repeated.

The electrostatic image bearing member 1 (the photosensitive drum) comprises a photosensitive layer 15 and the conductive substrate 16, and is rotated in the direction of an arrow. In the developing zone, the developing sleeve 4, a non-magnetic cylinder, which is a developer carrying member, is rotated so as to move in the same direction as the direction in which the electrostatic image bearing member 1 is rotated. In the inside of the developing sleeve 4, a multi-polar permanent magnet 14 (magnet roll) serving as a magnetic field generating means is non-rotatably provided. The one-component insulative magnetic developer 10 held in the developing assembly 9 having a stirring rod 13 is coated on the surface of the non-magnetic cylinder (developing sleeve 4), and, for example, negative triboelectric charge is imparted to the developer by the friction between the surface of the developing sleeve 4 and the the magnetic toner particles. A magnetic doctor blade 11 made of iron is disposed in proximity (with a space of from 50 μm to 500 μm) to the surface of the cylinder and also opposingly to one of the magnetic pole positions of the multi-polar permanent magnet 14. Thus, the thickness of a developer layer can be controlled to be small (from 30 μm to 300 μm) and uniform so that a developer layer smaller in thickness than the gap between the electrostatic image bearing member 1 and developer sleeve 4 in the developing zone can be formed in a non-contact state. The rotational speed of this developing sleeve 4 is regulated so that the peripheral speed of the sleeve can be substantially equal or close to the speed of the peripheral speed of the electrostatic image bearing surface. As the magnetic doctor blade 11, a permanent magnet may be used in place of iron to form an opposing magnetic pole. In the developing zone, the AC bias or pulse bias may be applied through the bias means 12, across the developing sleeve 4 and the surface of the electrostatic image holding member. This AC bias may preferably have a frequency (f) of from 200 to 4,000 Hz and a Vpp of from 500 to 3,000 V.

When the magnetic toner particles are moved in the developing zone, the magnetic toner particles are moved to the side of the electrostatic image bearing member 1 by the electrostatic force of the electrostatic image bearing surface and the action of the AC bias or pulse bias.

In place of the doctor blade 11, an elastic blade formed of an elastic material such as silicone rubber may be used so that the layer thickness of the developer layer can be controlled by pressing it against the surface of the electrostatic image bearing member 1 and the developer layer having a given thickness may be formed on the developing sleeve 4.

In the case when the magnetic toner having the specifically designed surface-modified fine silica powder of the present invention is used, the discharge wire of the primary charging assembly 2 can be well prevented or hindered from being soiled, even when the photosensitive member 1 is the amorphous silicon drum and a large corona discharge current is flowed through the primary charging assembly 2.

The present invention will be described below in greater detail by giving Examples. The present invention is by no means limited by these.

Preparation Example of Surface-modified Fine Silica Powder 1

Fumed silica (specific surface area: 380 $m^2/g$; water content: 2.35% by weight; bulk density: 26.8 g/lit.) in an amount of 100 parts by weight was put in a container having a high-speed mixer, and, while stirring at 8,500 r.p.m. in a nitrogen atmosphere, 20 parts by weight of hexamethyldisilazane was sprayed thereon. After the stirring was further continued for 5 minutes, the resulting powder liquid was refluxed with stirring at 200° C. for 3 hours in a nitrogen stream. Thereafter, the treated product was cooled to room temperature to give surface-modified fine silica powder 1. The surface-modified fine silica powder 1 thus obtained had a specific surface area of 240 $m^2/g$, a hydrophobicity of 79% and a bulk density of 43.5 g/lit.

Preparation Examples of Surface-modified Fine Silica Powders 2 to 7

Surface-modified fine silica powders 2 to 7 were obtained in the same manner as in Preparation Example of Surface-modified Fine Silica Powder 1 except that the fumed silica and the amount of hexamethyldisilazane were changed as shown in Table 1. Results obtained are shown in Table 1.

Preparation Examples of Comparative Surface-modified Fine Silica Powders 1 to 4

Comparative surface-modified fine silica powders 1 to 4 were obtained in the same manner as in Preparation Example of Surface-modified Fine Silica Powder 1 except that the fumed silica and the amount of hexamethyldisilazane were changed as shown in Table 1. Results obtained are shown in Table 1.

Preparation Examples of Comparative Surface-modified Fine Silica Powders 5 to 8

A commercially available surface-modified fine silica powder obtained by the batch treatment, TALLANOX-500 (trade name; available from Tulco Co.), commercially available surface-modified fine silica ponders obtained by the continuous treatment, R-812 (available from Nippon Aerosil Co., Ltd.) and R-972 (available from Nippon Aerosil Co., Ltd.), and a commercially available surface-modified fine silica powder obtained by the batch treatment, RX-200 (available from Degussa Japan Co., Ltd.) were designated as comparative surface-modified fine silica powders 5 to 8, respectively. Various physical properties of the comparative surface-modified fine silica powders 5 to 8 are shown in Table 1.

TABLE 1

| | Starting material fine silica powder | | | Amount of | Surface-modified fine silica powder | | |
|---|---|---|---|---|---|---|---|
| | Specific surface area ($m^2/g$) | Water content (wt. %) | Bulk density (g/l) | hexamethyldisilazane (pbw) | Specific surface area ($m^2/g$) | Hydrophobicity (%) | Bulk density (g/l) |
| Surface-modified fine silica powder: | | | | | | | |
| 1 | 380 | 2.35 | 26.8 | 20 | 240 | 79 | 40.5 |
| 2 | 320 | 1.56 | 35.2 | 18 | 224 | 68 | 42.4 |
| 3 | 350 | 3.87 | 30.1 | 22 | 205 | 86 | 44.3 |
| 4 | 380 | 1.85 | 27.8 | 20 | 213 | 72 | 39.8 |
| 5 | 480 | 4.26 | 23.4 | 25 | 286 | 89 | 38.5 |
| 6 | 380 | 0.73 | 28.4 | 15 | 253 | 63 | 41.3 |
| 7 | 380 | 4.65 | 29.3 | 25 | 184 | 93 | 47.6 |
| Comparative surface-modified fine silica powder: | | | | | | | |
| 1 | 200 | 3.67 | 33.2 | 20 | 132 | 98 | 33.1 |
| 2 | 300 | 5.27 | 45.3 | 30 | 167 | 96 | 57.2 |
| 3 | 350 | 0.46 | 26.8 | 20 | 260 | 57 | 45.7 |
| 4 | 380 | 0.60 | 27.9 | 10 | 172 | 53 | 31.0 |
| 5*1 | — | — | — | — | 225 | 80–99 | 75 |
| 6*2 | — | — | — | — | 260 | 40–80 | 50 |
| 7*3 | — | — | — | — | 110 | 30–50 | 50 |
| 8*4 | — | — | — | — | 150 | 97–99 | 40 |

*1: Commercially available surface-modified fine silica powder (TALLANOX-500:hexamethyldisilazane)
*2: Commercially available surface-modified fine silica powder (R-812:hexamethyldisilazane)
*3: Commercially available surface-modified fine silica powder (R-972:dimethyldichlorosilane)
*4: Commercially available surface-modified fine silica powder (R-200:hexamethyldisilazane)

| | (by weight) |
|---|---|
| Styrene | 66.0 parts |
| Butyl acrylate | 14.0 parts |
| Monobutyl maleate | 10.0 parts |
| Di-tert-butyl peroxide | 0.8 part |

A mixture of the above materials was dropwise added over a period of 4 hours in 200 parts by weight of cumene being refluxed (temperatures: 146° to 156° C.), where solution polymerization was completed under reflux of cumene, followed by removal of the cumene while raising the temperature up to 200° C. under reduced pressure.

In a mixture of the following materials, 30 parts by weight of the resulting styrene/acrylate copolymer was dissolved to give a mix solution.

| | (by weight) |
|---|---|
| Styrene | 49.0 parts |
| Butyl acrylate | 18.0 parts |
| Monobutyl maleate | 3.0 parts |
| Divinylbenzene | 0.3 part |

-continued

| | (by weight) |
|---|---|
| Benzoyl peroxide | 0.8 part |
| tert-Butylperoxy-2-ethylhexanoate | 0.6 part |

To the above mix solution, 170 parts by weight of water in which 0.15 part by weight of partially-saponified polyvinyl alcohol was added, followed by vigorous stirring to give a suspension. Then the resulting suspension was put in a reaction vessel in which 100 parts by weight of water had been added and the atmosphere had been replaced with nitrogen, to carry out polymerization at about 80° C. for 8 hours. After the polymerization was completed, the reaction product was filtrated, thoroughly washed with water and then dehydrated to dryness to give a styrene/acrylate copolymer composition.

Using a mixer, 100 parts by weight of the styrene/acrylate copolymer composition, 60 parts by weight of magnetite (average particle diameter: 0.2μ; FeO content: 26.5% by weight), 2 parts by weight of charge control agent shown as the exemplary compound Complex (II)-I and 3 parts by weight of low-molecular ethylene/propylene copolymer were preliminarily mixed, followed by melt-kneading using a twin-screw extruder having been set to a temperature of 130° C. The kneaded product was left to cool, and thereafter crushed. The crushed product was finely pulverized using a jet-stream fine grinding machine, followed by classification using an air classifier to give black magnetic resin particles 1 with a weight average particle diameter of 11.5μ.

To the magnetic resin particles 1 thus obtained, 0.4% by weight of surface-modified fine silica powder 1 was added. Magnetic toner 1 of the present invention was thus obtained.

Performances of this magnetic toner 1 were evaluated using a commercially available electrophotographic copier NP-9800 (manufactured by Canon Inc.) having an amorphous silicone photosensitive drum and in which the amorphous silicon drum was charged by applying electricity to the primary charging assembly at an electric current of about 1,000 μA. On the amorphous silicon drum, an electrostatic latent image having positive charges was formed. The magnetic toner had negative triboelectric charges. The electrostatic latent image was developed by normal development.

With regard to the soiling of discharge wire of the corona charging assembly, evaluation was made on the basis of the degree of density uneveness of halftone images after running on 200,000 copy sheets.

In order to evaluate image density stability during running, copies were continuously taken on 1,000,000 sheets. The image density was maintained at about 1.40 from the initial stage of the running and even after the running on 1,000,000 sheets, without causing any problem on image reproduction. For the purpose of evaluating stability under various environmental conditions, evaluation was made also in a high-humidity environment with a temperature of 30° C. and a humidity of 85% RH to confirm that the image density was stable at 1.25. Evaluation was also made in a low-humidity environment with a temperature of 23° C. and a humidity of 5% RH to confirm that the image density was stable at 1.35.

EXAMPLES 2 TO 7 & COMPARATIVE EXAMPLES 1 TO 8

Magnetic toners 2 to 7 and comparative magnetic toners 1 to 8 were prepared in the same manner as in Example 1 except that the surface-modified fine silica powder, the amount of the surface-modified fine silica powder, the charge control agent and the amount of the charge control agent were changed as shown in Table 2. Evaluation was also similarly made. Results obtained are shown in Table 2.

TABLE 2

| | Surface-modified fine silica powder | (1) (wt. %) | Charge control agent | (2) (pbw) | Soiling of wire after 200,000 sheets running | Image density *1: Initial *2 stage | After *2 1,000,000 sheets running | High-humidity environment (85% RH) | Low-humidity environment (5% RH) |
|---|---|---|---|---|---|---|---|---|---|
| Example: | | | | | | | | | |
| 1 | 1 | 0.4 | (II)-1 | 2 | A | 1.42 | 1.40 | 1.25 | 1.32 |
| 2 | 2 | 0.8 | (II)-1 | 3 | A | 1.40 | 1.39 | 1.28 | 1.42 |
| 3 | 3 | 0.5 | (I)-2 | 2 | A | 1.43 | 1.41 | 1.27 | 1.36 |
| 4 | 4 | 0.4 | (I)-2 | 1 | A | 1.42 | 1.42 | 1.26 | 1.38 |
| 5 | 5 | 0.4 | (II)-3 | 4 | A | 1.38 | 1.36 | 1.24 | 1.35 |
| 6 | 6 | 1.0 | (I)-4 | 2 | A | 1.35 | 1.37 | 1.22 | 1.33 |
| 7 | 7 | 0.6 | (II)-2 | 2 | AB | 1.36 | 1.33 | 1.30 | 1.30 |
| Comparative Example: | | | | | | | | | |
| 1 | Cp. 1 | 0.5 | (I)-2 | 2 | C | 1.33 | 1.11 | 1.16 | 1.07 |
| 2 | Cp. 2 | 0.4 | (I)-2 | 1 | C | 1.31 | 1.15 | 1.18 | 1.10 |
| 3 | Cp. 3 | 0.5 | (II)-1 | 2 | C | 1.25 | 1.04 | 1.07 | 1.26 |
| 4 | Cp. 4 | 0.4 | (II)-1 | 3 | C | 1.20 | 1.02 | 1.05 | 1.28 |
| 5 | Cp. 5 | 0.4 | (II)-1 | 2 | C | 1.34 | 1.28 | 1.15 | 1.27 |
| 6 | Cp. 6 | 0.4 | (II)-1 | 2 | C | 1.28 | 1.08 | 1.09 | 1.03 |
| 7 | Cp. 7 | 0.4 | (II)-1 | 2 | C | 1.24 | 1.03 | 1.12 | 1.04 |
| 8 | Cp. 8 | 0.4 | (II)-1 | 2 | C | 1.26 | 1.11 | 1.24 | 0.99 |

Cp: Comparative, pbw: part(s) by weight
(1): Amount of surface-modified fine silica powder added to magnetic resin particles
(2): Amount of charge control agent added to 100 pbw of binder resin TABLE 2-continued

| Surface-modified fine silica powder | (1) (wt. %) | Charge control agent | (2) (pbw) | Soiling of wire after 200,000 sheets running | Image density *1 Initial *2 stage | After *2 1,000,000 sheets running | High-humidity environment (85% RH) | Low-humidity environment (5% RH) |
|---|---|---|---|---|---|---|---|---|

In Table 2;
*1: Image density was measured using a reflection densitometer.
*2: Images were reproduced in normal-temperature and normal-humidity environment (23° C./60% RH).
*3: Images were reproduced in high-humidity environment (30° C./85% RH).
*4: Images were reproduced in low-humidity environment (23° C./5% RH).
Evaluation criterions:
A: No uneveness due to the soiling of wire is seen on halftone images.
AB: Uneveness due to the soiling of wire is seen little on halftone images.
C: Uneveness due to the soiling of wire is greatly seen on halftone images.

EXAMPLES 8 TO 14

As monomers, 340 parts by weight of polyoxypropylene type bisphenol A, 170 parts by weight of polyoxyethylene type bisphenol A and 430 parts by weight of terephthalic acid were mixed at an elevated temperature in a nitrogen stream, followed by addition of 0.04 part by weight of dibutyltin oxide, and reaction was carried out at a temperature maintained to 200° C. Thereafter, 60 parts by weight of 1,2,4-benzenetricarboxylic acid anhydride was added, and the reaction was further carried out to give a polyester resin.

Using a twin-screw extruder, 100 parts by weight of the above polyester resin, 60 parts by weight of magnetite and 3 parts by weight of low-molecular weight polypropylene were kneaded. The kneaded product was cooled, followed by pulverization and then classification to collect particles of 5 to 20μ in diameter, to give magnetic toner particles.

The magnetic toner particles thus obtained were mixed with each of the surface-modified fine silica powders of Examples 1 to 7. Magnetic toners for developing electrostatic images were thus prepared. Performances of the toners were evaluated using a commercially available high-speed copier NP-9800 (manufactured by Canon Inc.) having an amorphous silicon photosensitive drum, Results obtained are shown in Table 3.

COMPARATIVE EXAMPLES 9 TO 16

Magnetic toners for developing electrostatic images were prepared in the same manner as in Examples 1 to 7 except that the comparative surface-modified fine silica powders 1 to 8 were used. Results obtained are shown in Table 3 (Results of Evaluation on Toner Containing Surface-modified Fine Silica Powder).

TABLE 3

| | Amount of silica added to toner (wt. %) | Soil of wire after 80,000 sheets running | Image density *1 *2 Initial stage | After *2 100,000 sheets running | High humidity envir. (85% RH) | Low humidity envir. (5% RH) |
|---|---|---|---|---|---|---|
| Example: | | | | | | |
| 8 | 0.4 | A | 1.35 | 1.34 | 1.25 | 1.38 |
| 9 | 0.9 | A | 1.32 | 1.28 | 1.24 | 1.41 |
| 10 | 0.6 | A | 1.34 | 1.31 | 1.28 | 1.35 |
| 11 | 0.5 | A | 1.42 | 1.38 | 1.30 | 1.34 |
| 12 | 0.3 | A | 1.36 | 1.37 | 1.23 | 1.42 |
| 13 | 1.2 | A | 1.33 | 1.23 | 1.18 | 1.37 |

TABLE 3-continued

| | Amount of silica added to toner (wt. %) | Soil of wire after 80,000 sheets running | Image density *1 *2 Initial stage | After *2 100,000 sheets running | High humidity envir. (85% RH) | Low humidity envir. (5% RH) |
|---|---|---|---|---|---|---|
| 14 | 0.7 | AB | 1.34 | 1.30 | 1.32 | 1.20 |
| Comparative Example: | | | | | | |
| 9 | 0.4 | B | 1.32 | 1.04 | 1.18 | 1.05 |
| 10 | 0.5 | C | 1.28 | 1.06 | 1.22 | 1.07 |
| 11 | 0.4 | B | 1.22 | 0.98 | 1.02 | 1.28 |
| 12 | 0.5 | C | 1.18 | 0.94 | 1.03 | 1.26 |
| 13 | 0.4 | C | 1.26 | 1.20 | 1.18 | 1.18 |
| 14 | 0.4 | B | 1.24 | 1.10 | 1.14 | 1.03 |
| 15 | 0.4 | C | 1.25 | 1.12 | 1.17 | 0.98 |
| 16 | 0.4 | B | 1.28 | 1.05 | 1.16 | 0.96 |

*1: Image density was measured using a reflection densitometer.
*2: In the measurement of image density at the initial stage and after running on 100,000 sheets, images were reproduced in normal-temperature and normal-humidity environment (23° C./60% RH)
Evaluation criterions:
A: Excellent
AB: Good
B: Passable
C: Failure Since the surface-modified fine silica powder is free from agglomerates, has a appropriate hydrophobicity, and has a strong interaction with magnetic resin particles, which is strong enough to withhold the surface-modified fine silica powder from being released from the magnetic resin particles, the discharge wire can be much better prevented from being soiled even when the magnetic toner of the present invention is used in high-speed copying machines, in particular, high-speed copying machines making use of an amorphous silicone drum as a photosensitive drum. Moreover, since the surface-modified fine silica powder has a hydrophobicity within the range of from 60 to 95%, charges of the magnetic toner can be withheld from increasing during the running or in the low-humidity environment, making it possible to obtain the magnetic toner that can achieve a stable image density and a superior image reproduction.

What is claimed is:

1. A magnetic toner comprising magnetic resin particles containing at least a binder resin, a charge control agent and a magnetic powder, and a surface-modified fine silica powder; said surface-modified fine silica powder being a fine silica powder having been treated with hydrophobicizing agent, said surface-modified fine silica powder having a specific surface area of not less than 180 $m^2/g$, a hydrophobicity of from 60% to 95% and a bulk density of from 35 g/lit. to 49 g/lit., wherein said surface-modified fine silica powder comprises a hydrophobic fine silica powder prepared by a process comprising the steps of:

mixing 100 parts by weight of a fine silica powder having a specific surface area of not less than 300 $m^2/g$, a water content of from 0.5% by weight to 5% by weight and a bulk density of not more than 40 g/lit. and from 15 parts by weight to 25 parts by weight of hexamethyldisilazane; and heating said fine silica powder mixed with said hexamethyldisilazane at a temperature not lower than the boiling point of said hexamethyldisilazane.

2. The magnetic toner according to claim 1, wherein said surface-modified fine silica powder comprises a hydrophobic fine silica powder prepared by a process comprising the steps of;

mixing 100 parts by weight of a fine silica powder having a specific surface area of not less than 300 $m^2/g$, a water content of from 0.5% by weight to 5% by weight and a bulk density of not more than 40 g/lit and from 15 parts by weight to 25 parts by weight of hexamethyldisilazane; and heating said fine silica powder mixed with hexamethyldisilazane, at a temperature not lower than the boiling point of hexamethyldisilazane.

3. The magnetic toner according to claim 1, wherein said surface-modified fine silica powder has a specific surface area of from 200 $m^2/g$ to 320 $m^2/g$.

4. The magnetic toner according to claim 2, wherein said fine silica powder has a water content of from 0.7% by weight to 3% by weight.

5. The magnetic toner according to claim 1, wherein said surface-modified fine silica powder has a hydrophobicity of from 70% to 90%.

6. The magnetic toner according to claim 1, wherein said surface-modified fine silica powder has a bulk density of from 38 g/lit. to 45 g/lit.

7. The magnetic toner according to claim 1, wherein said surface-modified fine silica powder is added to said magnetic toner in an amount of from 0.05% by weight to 5% by weight.

8. The magnetic toner according to claim 1, wherein said surface-modified fine silica powder is added to said magnetic toner in an amount of from 0.1% by weight to 4% by weight.

9. The magnetic toner according to claim 1, wherein said binder resin comprises a styrene-acrylic copolymer.

10. The magnetic toner according to claim 1, wherein said binder resin comprises a vinyl copolymer having a carboxyl group.

11. The magnetic toner according to claim 1, wherein said binder resin comprises a styrene-acrylic copolymer having a carboxyl group.

12. The magnetic toner according to claim 1, wherein said binder resin comprises a polyester resin.

13. The magnetic toner according to claim 1, wherein said magnetic resin particles contain a charge control agent in an amount of from 0.1% by weight to 10% by weight on the basis of the binder resin.

14. The magnetic toner according to claim 1, wherein said magnetic resin particles contain an azo type metal complex.

15. The magnetic toner according to claim 1, wherein said magnetic resin particles contain an azo type metal complex represented by the formula:

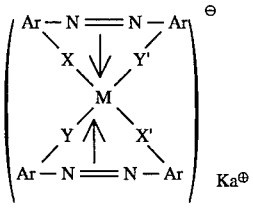

wherein M represents Sc, Ti, V, Cr, Co, Ni, Mn or Fe; Ar represents an aryl group which may have a substituent; X, X', Y and Y' each represent —S—, —O—, —CO—, —NH— or —NR—, wherein R represents an alkyl group having 1 to 4 carbon atoms; and $Ka^{\oplus}$ represents a hydrogen ion, a sodium ion, a potassium ion, an ammonium ion or an organic ammonium ion.

16. The magnetic toner according to claim 1, wherein said magnetic resin particles contain a basic organic acid metal complex.

17. The magnetic toner according to claim 1, wherein said magnetic resin particles contain a basic organic acid metal complex represented by the formula:

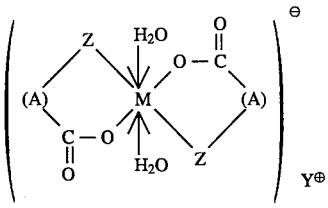

wherein M represents Sc, Ti, V, Cr, Co, Ni, Mn or Fe; A represents

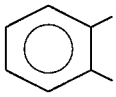

which may have a substituent comprising an alkyl group,

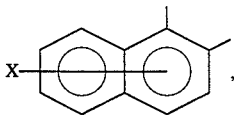

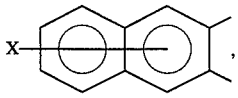

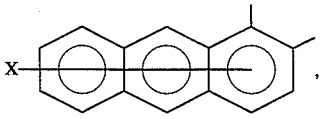

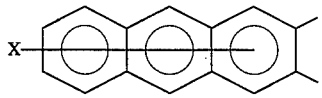

wherein X represents a substituent comprising a hydrogen atom, a halogen atom, a nitro group or an alkyl group, or

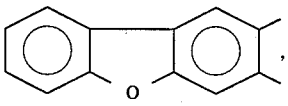

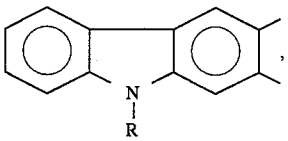

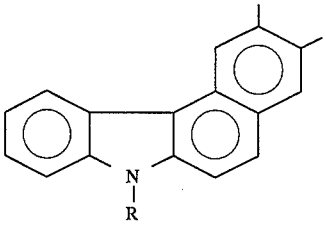

wherein R represents a hydrogen atom, an alkyl or alkenyl group having 1 to 18 carbon atoms; $Y^{\oplus}$ represents a hydrogen ion, a sodium ion, a potassium ion, an ammonium ion or an organic ammonium ion; and Z represents —O— or $$-\overset{\overset{\displaystyle O}{\|}}{C}-O-.$$

18. The magnetic toner according to claim 1, wherein said magnetic resin particles contain said magnetic powder in an amount of from 40 parts by weight to 150 parts by weight based on 100 parts by weight of resin components.

19. The magnetic toner according to claim 1, wherein said magnetic resin particles contain a waxy material in an amount of from 0.5 part by weight to 10 parts by weight based on 100 parts by weight of said binder resin.

20. The magnetic toner according to claim 2, wherein said fine silica powder has a specific surface area of from 350 $m^2/g$ to 500 $m^2/g$.

* * * * *